United States Patent [19]

Butler

[11] 4,444,359

[45] Apr. 24, 1984

[54] TOILET ROLL RECEPTACLE

[76] Inventor: Jack B. Butler, P.O. Box 1699, Kilgore, Tex. 75662

[21] Appl. No.: 394,791

[22] Filed: Jul. 2, 1982

[51] Int. Cl.[3] ..... B65H 19/00

[52] U.S. Cl. ..... 242/55.53; 225/51

[58] Field of Search ..... 242/55.3, 55.53, 55.2; 312/38–40; 225/46, 47, 51, 52

[56] References Cited

U.S. PATENT DOCUMENTS

| | | | |
|---|---|---|---|
| 3,007,650 | 11/1961 | Burton | 242/55.3 |
| 3,062,606 | 11/1962 | Magrauth | 312/41 |
| 4,375,874 | 3/1983 | Leotta et al. | 242/55.3 |

*Primary Examiner*—Leonard D. Christian
*Attorney, Agent, or Firm*—Harvey B. Jacobson

[57] ABSTRACT

A toilet roll receptacle adaptable for containing and normally concealing a roll of toilet tissues, the receptacle including a body portion providing an enclosure formed by top, bottom, side and back walls and open at the front, a door covering said open front and a hinge connection pivotally securing the door to said sidewalls adjacent the bottom wall. The door includes support means for roll paper formed with a flanged base extending from opposite side arms substantially perpendicularly from said base, means securing said base onto a portion about said midpoint of the sides of the door, means supporting a roll of toilet tissues between said arms, and elastomeric abutment or stop members mounted at each end of the path traversed by the door for limiting displacement of the door. One stop member is mounted from a bracket on a sidewall and provides abutment when the door is in its closed position while another stop member is mounted on an extension of the hinge connection and provides abutment when the door is in a full open position, normally a 90° rotation about the hinge connection. Support member for the roll includes a spring loaded spindle for engagement at the free ends of the side arms of the support member.

10 Claims, 5 Drawing Figures

FIG. 3
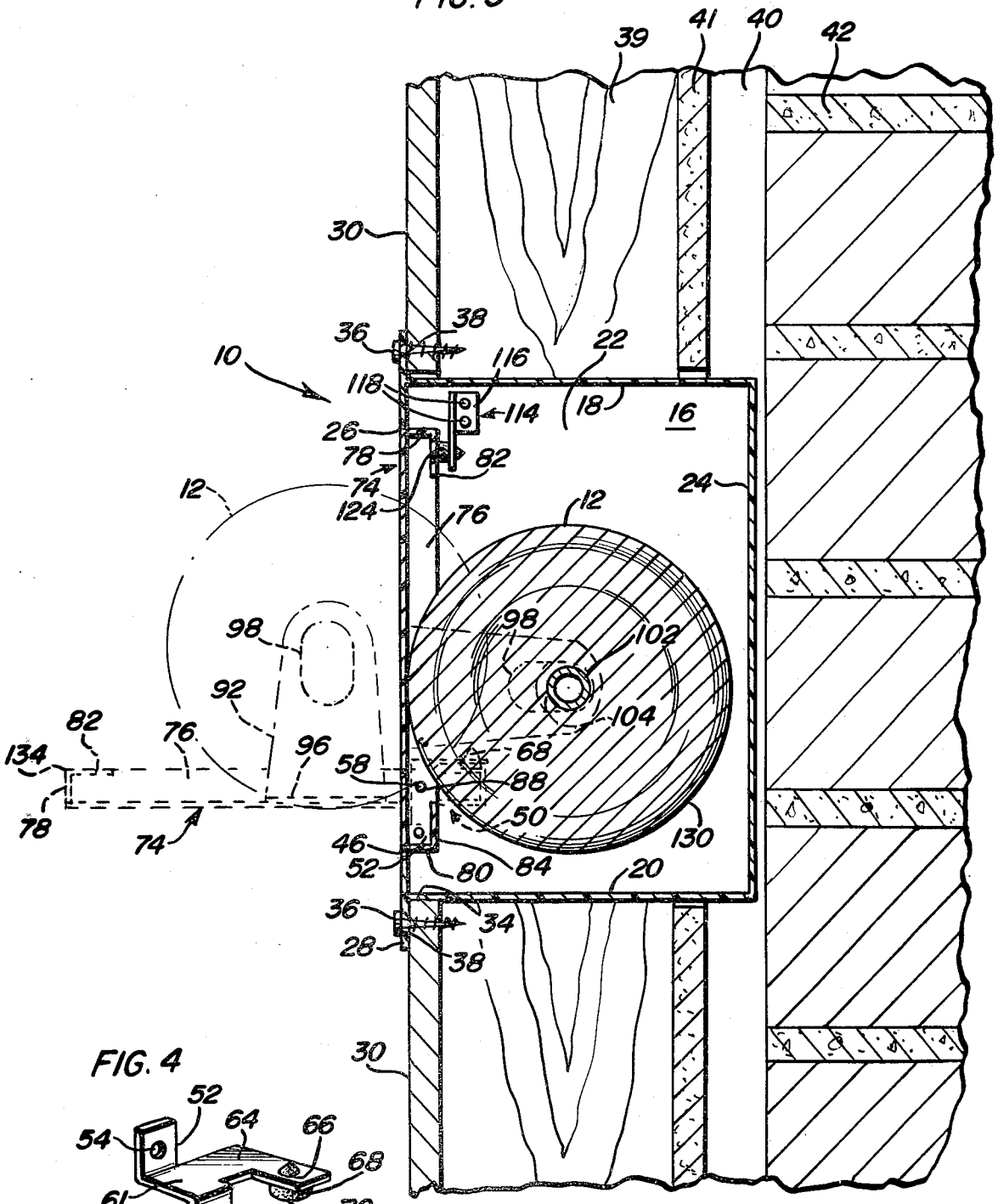
FIG. 4
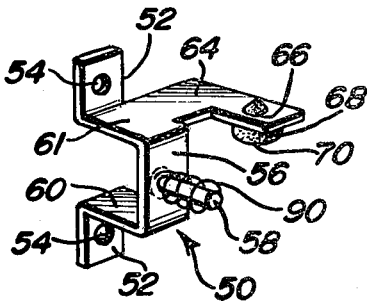
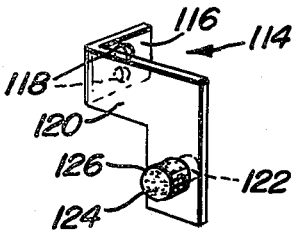
FIG. 5

TOILET ROLL RECEPTACLE

BACKGROUND OF THE INVENTION

1. Field of the Invention

The present invention relates to a toilet roll receptacle containing a mounted roll of toilet tissues and in which the roll of toilet tissues is hidden from view until use thereof, and more particularly the invention relates to a toilet roll receptacle constructed in a container or enclosure formed by the top, bottom, side and back walls and opening at the front with a hinged door covering the open front. The toilet roll receptacle is easily installed in an exterior wall and in which the rear portion thereof may extend or protrude behind insulation or "Celotex" material into a one-inch air space. Also, the toilet roll receptacle may be installed in an inner wall where 2×6 studs are used and where adequate clearance between ends of the container or receptacle are adequate. The receptacle is provided with a mounting flange and the doors together with the mounting flange are available in colors to compliment the decor of the bathroom. Within the purview of the invention, existing and exposed toilet tissue holders are replaceable with the improved toilet roll receptacle of the present invention by following simple instructions enclosed with the toilet roll receptacle kit or assembly. The receptacle can be constructed of polystyrene or fiberglass or similar type materials.

2. Description of Prior Art

Various prior art and U.S. patents relating to toilet roll receptacles are of interest to the present invention and include the following U.S. patents:

U.S. Pat. No. 3,062,606—A. G. Magrauth
U.S. Pat. No. 3,167,367—M. Rozlog et al
U.S. Pat. No. 3,271,090—B. E. Smithers
U.S. Pat. No. 3,450,363—J. L. Williams
U.S. Pat. No. 3,633,838—A. G. Krueger
U.S. Pat. No. 3,760,976—N. Andreacchio
U.S. Pat. No. 4,089,481—R. W. Ciuci
U.S. Pat. No. 4,191,317—L. J. Harkins The patent to Magrauth discloses a concealed toilet roll container having a hinged door and a linkage arm actuated by opening the door to swing out a toilet roll mounted on a support which is pivoted from an opposite side of the box frame. The patent to Smithers discloses a similar arrangement except that the door is hinged along its bottom edge. Other patents are of more general interest. None of these patents discloses all of the specific details of the present invention in such a way as to bear upon the patentability of any claims of the present invention.

SUMMARY OF THE INVENTION

An object and advantage of the present invention is to provide an improved toilet roll receptacle for containing a roll of toilet tissues that is completely hidden from view until used. The toilet roll receptacle eliminates unsightly or exposed toilet tissues and the receptacle is usable in residential and commercial installations.

Another object of the present invention is to provide a toilet roll receptacle as units for containing a roll of toilet tissues and in which the receptacle is easily installed by use of instructions enclosed with kits of each unit, and in which the toilet roll receptacle replaces existing exposed toilet tissue holders. The toilet roll receptacle of the present invention includes doors and a mounting flange which are available in multiple colors to complement existing "Sheetrock", wallpaper, tile and similar decor in the bathroom. The toilet roll receptacle of the present invention may be constructed of polystyrene or fiberglass or other low cost material and thus provide a toilet roll receptacle for hiding the roll of toilet tissues from view until the receptacle door is opened exposing for general uses the roll of toilet tissues therein.

Another and additional object of the present invention is to provide a toilet roll receptacle containing a roll of toilet tissue and which may be typically installed on exterior or interior walls of the home. Where the receptacle is installed in an exterior wall, such as where 2×4 studs are used, the receptacle may have its rear portion protrude into an air space behind insulation material, and where the receptacle is installed in an interior wall that uses 2×6 studs as are common in walls of back-to-back bathrooms, adequate clearance between the end of the container and "Sheetrock" or paneling is provided alongside of each of the studs or other support of the toilet roll receptacle.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is an enlarged sectional view taken along lines 3—3 of FIG. 1.

FIG. 4 is a perspective view of the door hinge or pivot and lower stop member used when the door is in open position.

FIG. 5 is a perspective view of an upper stop member mounted on a sidewall interior of the toilet roll receptacle for engagement with the door when in its closed position.

DESCRIPTION OF THE PREFERRED EMBODIMENT

Figure 1:
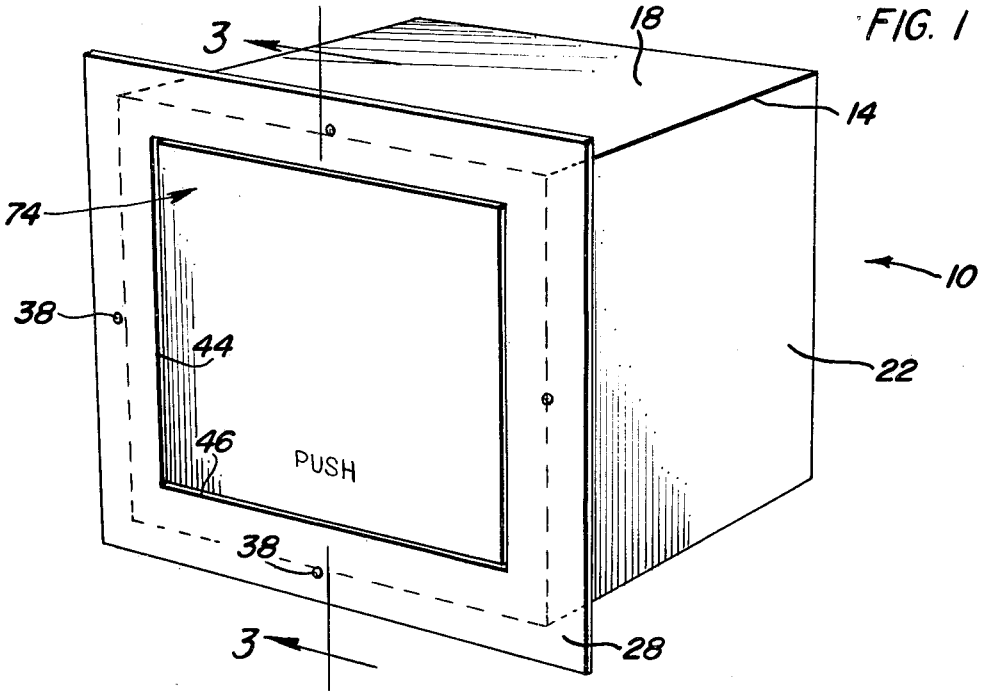
FIG. 1 is a front perspective view of the toilet roll receptacle for containing a hidden roll of toilet tissue with the door in closed position according to the present invention.

Referring now to the drawings, there is shown a toilet roll receptacle 10 for containing a roll 12 of toilet tissues, the receptacle having a body portion 14 for enclosing an interior space 16 including a top 18, a bottom wall 20, sidewalls 22, a back wall 24 and a front opening 26. Around the front opening 26 is a generally rectangular mounting strip 28 for mounting the receptacle flush to a surface of "Sheetrock" or paneling 30 in which the toilet roll receptacle 10 fits within a recess 34 in the panel 30, such that the mounting strip 28 is flush throughout its entirety and is secured to the paneling 30 by mounting screws 36 passing through mounting holes or apertures 38 and threadedly secured into the paneling 30 as shown in FIG. 3.

The recess 34 in the panel 30 for receiving the toilet roll receptacle 10 is sufficiently deep where space is provided between walls using 2×6 studs, but in an exterior wall where 2×4 studs 39 are used, the recess 34 will extend beyond the extremity of the 2×4 stud and the toilet roll receptacle 10 will have its back wall 24 extending into a conventional air space 40 between the insulation or sheeting 41 such as "Celotex" and the exterior facing or brick and mortar structures 42 shown in FIG. 3.

The mounting flange 28 and the entire toilet roll receptacle 10 may be constructed integrally with or of separate materials whether polystyrene or a fiberglass material or other convenient material forming walls, mounting strip, and the like. On interior surfaces of each of the sidewalls 22 and positioned generally intermediate a vertical midpoint 44 and its bottom extremity 46, there is a U-shaped pivot bracket 50 having mounting arms 52 each with an aperture 54 for receiving a bolt or rivet or other fastener. The bracket 50 has central portion 56 of the U-shaped bracket for centrally mounting thereon a pin 58 by it being welded or otherwise similarly secured to the central U-shaped portion 56. The sides 60, 61 of the U-shaped bracket 50 are of sufficient dimension to provide that the central portion 56 is positioned sufficiently away from the interior surface of the sidewalls 22 so that the central portion 56 provides for the pin 58 to extend into the front opening 26. The side 61 of the U-shaped bracket 50 has an L-shaped extension 64 with an aperture 66 passing therethrough proximate the free end of the extension 64. A rubber stop member 68 is securely fixed within the aperture 66, and as illustrated in FIG. 4, the lower portion thereof is provided with sufficiently large surface area 70 to provide engagement with a surface to be restrained or positioned firmly in place. The material of the rubber stop may be of any elastometric material.

A door 74 of sheet material similar to the material forming the toilet roll receptacle 10 is of sufficient size and dimension to close the front opening 26 and has side strength panels 76, a top and bottom strength panel 78, 80 and further includes rigid top and bottom panels 82, 84. This structure provides complete and substantial strength to the door and the toilet roll receptacle 10. The door is mounted in the front opening 26 by the pins 58 passing through mating openings or apertures 88. Interposed between the exterior of the side panels 76 and the central portion 56 of the U-shaped bracket 50 and mounted centrally along the pin 58 is a small compression spring 90 that provides a small bias or force imposed on the door 74 to restrain ease of pivotal movement of the door 74 about the pins 58.

Figure 2:
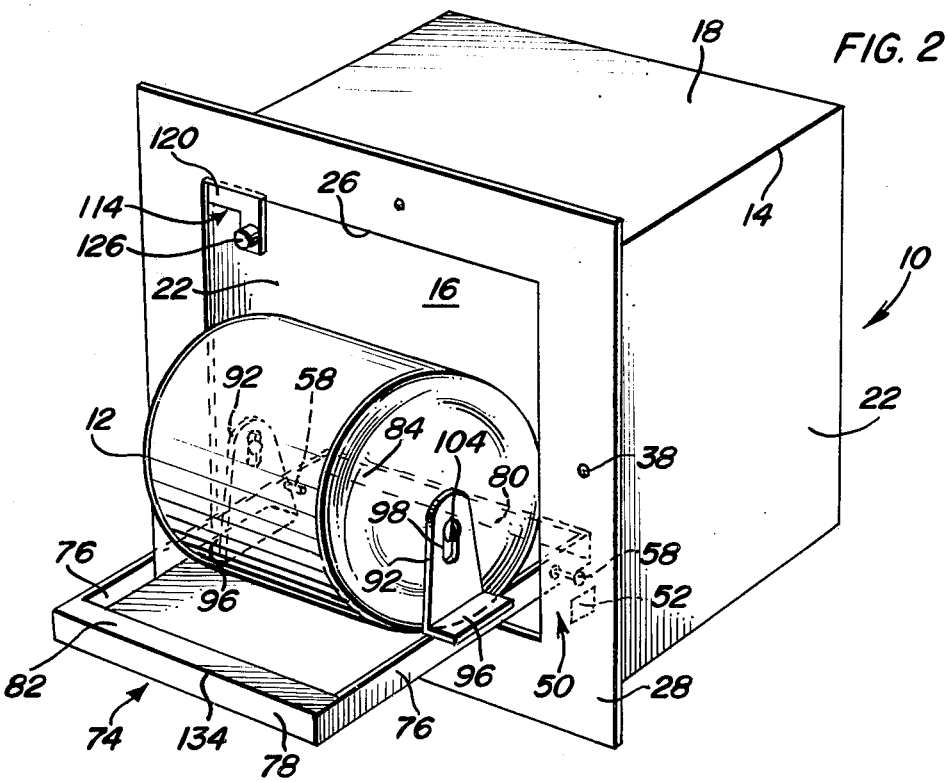
FIG. 2 is a similar perspective view of a toilet roll receptacle and in which the door covering the receptacle is in an open position having the roll of toilet tissue available for use.

When the door 74 is in its open position as shown in FIGS. 2 and 3, the bottom rigid panel 84 engages the surface area 70 of the rubber stop member 68, and the extension 64 is of sufficient length, effective moment arm and strength to provide that the door 74 is firmly positioned while in its open condition.

On the interior surface of the door 74, a set of spindle support members 92 each with a flanged foot or base 96 are secured to the inner surface of the door 74 about the midpoint thereof by welding or other fastener means. Along the upper and free extremity of the support members 92 is an elongated aperture 98 adapted to receive flanged or recessed ends 102 of a spring loaded spindle 104, the ends 102 being received within the elongated aperture 98 and thus the spring loaded spindle 104 is available for support of the roll 12 of toilet tissues.

Along one or each side of sidewall 22 and in the interior space 16, a stop bracket 114 is mounted and which includes a base 116 with mounting apertures 118 for fasteners to pass through and engage securely and fixedly with the adjacent sidewall 22, so that its outwardly extending portion 120 is provided with an aperture 122 for receiving a stop member 124 which may be of rubber or other elastomeric material. The stop member 124 has on one side a large surface area 126 and it is positioned such that the extending portion 120 is of sufficient length that the surface area 126 extends within the front opening 26 and engages for receiving impactment with the surface of the top rigid panel 82 when door 74 is closed.

The elongated aperture 98 allows for movement or displacement of the roll 12 such that its peripheral surface 130 engages with the inner surface of the door 74 and frictionally contacts that surface during the period that toilet tissues of the roll 12 are being dispensed from the roll. In this way, when tissues are pulled for acquiring a given length of toilet tissues, the roll 12 does not continue to rotate after the pull upon the toilet tissues has ceased, and thus the problem of acquiring unnecessary lengths of toilet tissues and wastage thereof is obviated.

Along the surface edge on element 134 formed between top strength panels 78 and top rigid panel 82, there may be a tear bar or surface formed by these two surface 78, 82 such as, if necessary, the element 134 may be used as a tear bar, to enable the user to quickly tear a desired length of the tissues from the roll 12.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A toilet roll receptacle for containing a roll of toilet tissues, the receptacle comprising a body portion providing an enclosure formed by top, bottom, side and back walls and open at the front, a door covering said open front, a hinge connection securing the door pivotally to said side walls and the hinge connection being positioned along the sidewalls intermediate a midpoint of the sides of the door and an extremity thereof for matingly engaging with side elements of the door, support means for said roll of toilet tissues and including a flanged base having opposite side arms extending from said base, means securing said base onto a portion about said midpoint of the sides of the door, and stop means mounted at each end of the path traversed by the door for receiving impactment and thereby limiting further displacement of the door.

2. The invention according to claim 1 wherein the body portion includes a mounting flange extending peripherally about the open front thereof and having apertures for receiving mounting screws for mounting the receptacle in a recess in a bathroom or powder room.

3. The invention according to claim 1 wherein the toilet roll receptacle includes spring means included in the hinge connection for providing a bias means between the door and the sidewalls of the body portion of the toilet roll receptacle, said bias means providing restraint upon the door from displacement about the hinge connection.

4. The invention according to claim 1 wherein elongated apertures are included in the side arms of said support means for receiving a spring loaded spindle which may ride along the length of the elongated aperture so that the roll has its periphery engaging with the interior surface of the door for providing friction to the rotation of the roll when a desired length of tissues is pulled from the roll.

5. The invention according to claim 1 wherein the hinge connection includes a U-shaped pivot bracket mounted on said sidewalls and is provided with an extension from a side of the U-shaped pivot bracket for supporting a rubber stop included in said stop means.

6. The invention according to claim 1 wherein said stop means includes a bracket mounted on at least one sidewall and the portion extending from said sidewall so that a portion of the free end thereof extends into engagement with a top rigid panel of said door, the bracket being provided with a rubber stop having an area for engaging the top rigid panel on the door.

7. A paper roll holder for supporting and concealing roll of paper comprising frame means adapted to be secured to the open front of a wall recess, a door closing said open front, hinge means mounting said door to said frame means for pivoting about a generally horizontal axis adjacent the lower edge of the door, support arms mounted on and extending from the interior of the door for rotatably mounting a spindle thereon with the spindle being detachable to enable a roll of paper to be mounted thereon for movement from a concealed position within the recess to an accessible position outwardly of the frame means, wherein said frame means includes a stop means to limit pivot movement of the door to a position substantially perpendicular to the frame means and generally horizontally disposed with the support arms extending upwardly therefrom, the support arms including mounting means for the spindle for enabling gravity to move the spindle and paper roll thereon downwardly when the door is in the horizontally disposed position, so that the periphery of the paper roll frictionally engages the top surface of the door to control the dispensing of paper therefrom.

8. The structure as defined in claim 7 wherein said door has a planar outer surface adapted to receive a covering or coating compatible with the decor of the wall surface surrounding the wall recess.

9. The structure as defined in claim 7 wherein the mounting means for the spindle comprises slots in the support arms disposed vertically when the door is in the horizontally disposed position.

10. The structure as defined in claim 7 wherein the hinge means includes hinge fittings for the door secured on opposite interior sides of the frame, and wherein said stop means includes a stop member integrated with one of said hinge fittings.

* * * * *